US005636770A

United States Patent [19]

Hachinohe et al.

[11] Patent Number: 5,636,770

[45] Date of Patent: Jun. 10, 1997

[54] AEROSOL DIP TUBE

[75] Inventors: Yukio Hachinohe; Kunio Koyama; Hideaki Saito, all of Saitama-ken, Japan

[73] Assignee: Toyo Aerosol Industry Co. Ltd., Tokyo, Japan

[21] Appl. No.: 429,044

[22] Filed: Apr. 26, 1995

[30] Foreign Application Priority Data

Jun. 13, 1994 [JP] Japan ..... 6-130704

[51] Int. Cl.[6] ..... B67D 5/60

[52] U.S. Cl. ..... 222/402.1; 222/464.4; 239/337

[58] Field of Search ..... 222/211, 402.1, 222/416, 464.3, 464.4; 239/333, 337, 345

[56] References Cited

U.S. PATENT DOCUMENTS

| | | | |
|---|---|---|---|
| 3,088,680 | 5/1963 | Fulton et al. | 222/464.4 X |
| 3,490,656 | 1/1970 | Taschner | 222/464.4 X |
| 3,667,655 | 6/1972 | Knieriem, Jr. | 222/464 |
| 4,830,235 | 5/1989 | Miller | 222/464.4 |
| 5,215,227 | 6/1993 | Farner | 222/464.4 X |

FOREIGN PATENT DOCUMENTS

| | | | |
|---|---|---|---|
| 0338844 | 10/1989 | European Pat. Off. . | |
| 55-13626 | 1/1980 | Japan . | |
| 56-39578 | 9/1981 | Japan . | |
| 62-118552 | 7/1987 | Japan . | |
| 1234693 | 6/1971 | United Kingdom | 222/464.4 |
| 2136057 | 9/1984 | United Kingdom | 222/464.4 |
| 2234555 | 2/1991 | United Kingdom . | |

OTHER PUBLICATIONS

European Search Report corresponding to EP 95 10 6422, dated Sep. 11, 1995.

*Primary Examiner*—Joseph Kaufman

*Attorney, Agent, or Firm*—Michael D. Bednarek; Kilpatrick Stockton LLP

[57] ABSTRACT

A dip tube whose tip portion can reach the nooks at the bottom of an aerosol container, so that the aerosol content therein can be assuredly sprayed with substantially no aerosol content being left unused. A weight fixed around the dip tube is arranged so that it does not hit the inner surface of the aerosol container. The dip tube is provided in an aerosol container and an end portion thereof is connected to a valve mechanism. The opposite end of the dip tube is left free. The dip tube conveys the aerosol content from the container to the valve mechanism where it is emitted as an aerosol spray. The dip tube includes a pliable tube main body and a tubular weight fixed on the tube main body adjacent to the free end. An end portion of the tube main body is therefore left exposed by the tubular weight. The length of the exposed end portion is selected so that the end portion is assuredly interposed between the weight and the interior surface of the container.

14 Claims, 4 Drawing Sheets

AEROSOL DIP TUBE

BACKGROUND OF THE INVENTION (1) Field of the Invention

The present invention relates to an aerosol dip tube for conveying the contents of an aerosol container to a valve mechanism provided on the aerosol container.

(2) Description of Related Art

An aerosol dip tube is provided in an aerosol container with one end portion thereof connected to a valve mechanism. The dip tube conveys the contents of the container to the valve mechanism so that it can be sprayed as an aerosol. Such dip tubes include those made from relatively rigid resins which can hardly be bent and those made from soft and elastic resins which can easily be bent.

If a dip tube made from a rigid resin is used in an aerosol container, the dip tube cannot follow the aerosol content, which moves when the aerosol container is slanted or inverted, because the container is not designed to be used in such slanted or inverted state. Accordingly, such an aerosol container suffers because some of the aerosol content remains unused while only the propellant gas is exhausted. Therefore, although some of the aerosol content may still remain in the container, it is impossible to spray it.

Dip tubes made from bendable, soft and elastic materials are being explored to solve the problems described above. A dip tube made from such a soft and elastic material is designed to follow the aerosol content as the aerosol container is slanted, and is therefore constantly brought into contact with the aerosol content within the aerosol container.

For example, in Japanese Unexamined Utility Model Publication No. Sho 62-118552, a thick weight is fixed to the free end portion of a dip tube made from a soft and elastic material. According to this arrangement, the dip tube bends because of the weight as the aerosol container is slanted. This allows the free end portion of the dip tube to move such that it can constantly be brought into contact with the aerosol content. Thus, the aerosol content in the container may be assuredly consumed.

Another dip tube with a similar objective is disclosed in Japanese Utility Model Publication No. Sho 56-39578. According to this device, a holding frame is attached to a free end of a dip tube made from a soft and elastic material. A thick weight is embedded in this holding frame. This arrangement enables the dip tube to bend as the aerosol container is slanted and moves the free end portion of the dip tube into constant contact with the aerosol content.

Another dip tube is disclosed in Japanese Unexamined Utility Model Publication No. Sho 55-13626. A thick weight is attached to the free end portion of a soft and elastic dip tube. The weight is covered on its circumference thereof with a shock absorbing material.

However, in a dip tube having a thick weight fixed at the free end portion thereof, as disclosed in Japanese Unexamined Utility Model Publication No. Sho 62-118552, the free end of the dip tube cannot reach nooks at the bottom of the aerosol container because the weight strikes the side of the aerosol container. This causes the contents of the aerosol container to remain not fully used. In addition, in the dip tube having a weight fixed at the free end portion thereof, the weight hits the inner surface of the aerosol container when the weight moves as the aerosol container is slanted. This may damage a coating etc. applied on the inner surface of the aerosol container. If the aerosol content is corrosive, for example, the aerosol container could corrode due to this damage. This could cause the properties of the aerosol content to change or cause accidents such as gas leakage due to the damage to the aerosol container.

Japanese Utility Mode Publication No. Sho 56-39578 discloses a dip tube having a free end to which a holding frame made from a soft and elastic material is attached. A thick weight is embedded in this holding frame. This arrangement has disadvantages because the structure of the tube is relatively complicated. This complicates manufacture of the dip tube and raises the production costs. Further, the weight provided at the free end portion of the dip tube strikes the side of the aerosol container, thereby preventing the free end of the dip tube from assuredly reaching the nooks at the bottom of the aerosol container and causing the contents to be not fully used.

In the dip tube disclosed in Japanese Unexamined Utility Model Publication No. Sho 55-13626, the outer periphery of a thick weight is attached to the free end of a dip tube and is covered with a shock absorbing material. Therefore, the inner surface of the aerosol container is not damaged, but other previously mentioned disadvantages, such as the complicated structure of the dip tube increasing the production unit cost, or the content of the aerosol remaining not fully used, are not completely avoided.

SUMMARY OF THE INVENTION

In order to solve the problems described above, an aerosol dip tube according to the present invention has a substrative end portion connected to a valve mechanism. The dip tube hangs down into an aerosol container to convey the aerosol content from the free end portion of the dip tube to the valve mechanism. The dip tube includes a tube main body made from a soft and elastic material and a thin, tubular weight fixed to the outer peripheral surface of the tube main body. The protruding portion of the tube main body protrudes 5 to 15 mm from the end of the tubular weight.

The dip tube according to the present invention has a small external diameter with a thin weight. Accordingly, such a tubular weight has an external diameter only slightly larger than that of the dip tube, thereby changing the external diameter of the tube main body very little as a whole. Additionally, the protruding 5 to 15 mm portion of the free end portion of the tube main body eliminates problems such as restricted movement due to the weight striking the side of the aerosol container even when the free end portion of the tube main body can move to every nook at the bottom of the aerosol container. Therefore, the free end portion of the tube main body can reach every nook at the bottom of the aerosol container, so that substantially the entire aerosol content can be assuredly sprayed, with no aerosol content being left unused, leading to economical use of the aerosol product. In this case, if the length of the tube main body to be protruding from the tubular weight is less than 5 mm, it is difficult for the free end of the tube main body to reach the nooks of the aerosol container. On the other hand, if the length of the tube main body protruding from the tubular weight is greater than 15 mm, the movement of the dip tube in accordance with the slanting of the aerosol container is undesirably hindered.

Further, even when the tube main body moves about as the aerosol container is slanted, only the free end of the tube main body may hit or otherwise touch the inner surface of the aerosol container. Thus, the tubular weight does not substantially contact the inner surface of the aerosol container, since the tube main body protrudes by 5 to 15 mm from the lower end of the tubular weight. The inner surface of the aerosol container is therefore protected from being damaged, and the tubular weight does not need to be embedded in holding frame or covered with a shock absorbing material, as in the above-described conventional arrangements.

The tubular weight can be fixed onto the tube main body by fitting it on the outer periphery of the dip tube and caulking it lightly about its circumference adjoining the dip tube. This makes attaching the tubular weight very easy. The position at which the tubular weight is attached can easily be selected by sliding the tubular weight along the outer peripheral surface of the tube main body before the weight is caulked. Accordingly, the optimum position of the tubular weight for spraying can easily be selected by freely moving the weight, depending on the size of the aerosol container etc. In caulking the tubular weight, it is preferable to provide the tubular weight with a slit along the longitudinal direction thereof. This allows even and complete caulking over the length of the weight to more reliably secure the weight on the tube main body.

The tubular weight can be formed with a small outer diameter so that the weight is unlikely to hit the inner wall surface of the aerosol container. Accordingly, the tubular weight is preferably formed to have an outer diameter of 4 to 6 mm. An outer diameter of less than 4 mm causes poor workability in connection with the diameter of the tube main body; whereas an outer diameter greater than 6 mm makes the weight more likely to hit the inner wall surface of the aerosol container.

Meanwhile, the tubular weight preferably has a length of 20 to 40 mm. If the length of the tubular weight is less than 20 mm, it is not heavy enough to allow the tube main body to securely follow the movement of the aerosol content when the aerosol container is, for example, slanted. On the other hand, if the length of the tubular weight is greater than 40 mm, the tube main body tends to bend awkwardly.

A tubular weight made from a stainless steel material, for example, will offer high corrosion resistance. Therefore, even when the aerosol content is a corrosive material, the aerosol content can be used safely.

The present invention is not limited to the above description, and other objects, advantages, features, and uses will become apparent by reference to the following detailed description considered in connection with the accompanying drawings. Additionally, it should be noted that any appropriate alterations not departing from the spirit of the invention are to be included in the scope of the invention disclosed herein.

DETAILED DESCRIPTION OF THE PREFERRED EMBODIMENT

Figure 1:
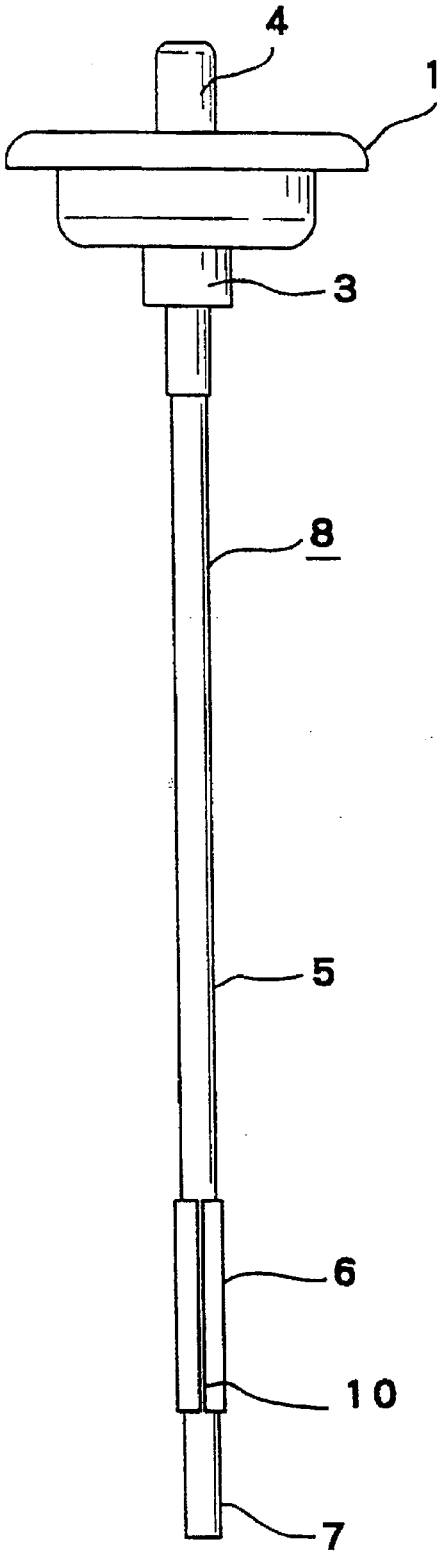
FIG. 1 is a side view illustrating a dip tube connected to a housing.

A preferred embodiment of the present invention is described below with reference to the accompanying drawings.

A cover 1 is fixed to the upper end of an aerosol container 2. On the lower, inner surface of the cover 1, a housing 3 in which a valve mechanism (not shown) is mounted is fixed. A stem 4, which is connected at its lower end to the valve mechanism in housing 3, protrudes outwardly from the upper end of the cover 1.

The substrative end portion of a tube main body 5, which is made from a bendable, soft and elastic material, is inserted in the housing 3. Therefore, the tube main body 5 is connected to the housing 3 containing the valve mechanism. The tube main body 5 is provided with, at the outer peripheral surface thereof, with a tubular weight 6 made from a tubular stainless steel material.

This tubular weight 6 preferably has an outer diameter of 4 to 6 mm and an inner diameter of 2 to 3 mm. More preferably, the length (vertical directions in the figure) and thickness of the tubular weight 6 are preferably between 20.0 mm and 40.0 mm, and between 0.7 mm to 1.5 mm, respectively. In this embodiment, the tubular weight 6 is designed to have an outer diameter of 4.6 mm and an inner diameter of 3.4 mm, (i.e. a thickness of 1.2 mm), and a length of 33.0 mm. Furthermore, the tubular weight 6 preferably weighs 1.5 to 3.0 g. In this particular embodiment, the tubular weight 6 has of 2.5 g.

The thus formed tubular weight 6 is slid onto the tip of the tube main body 5 and slid thereon to allow the free end portion of the tube main body 5 to protrude 5 mm to 15 mm from the lower end of tubular weight 6. This constitutes a tip protrusion 7 at the tip of the tube main body 5. In this particular embodiment, this tip protrusion 7 has a length of 10 mm.

Figure 2:
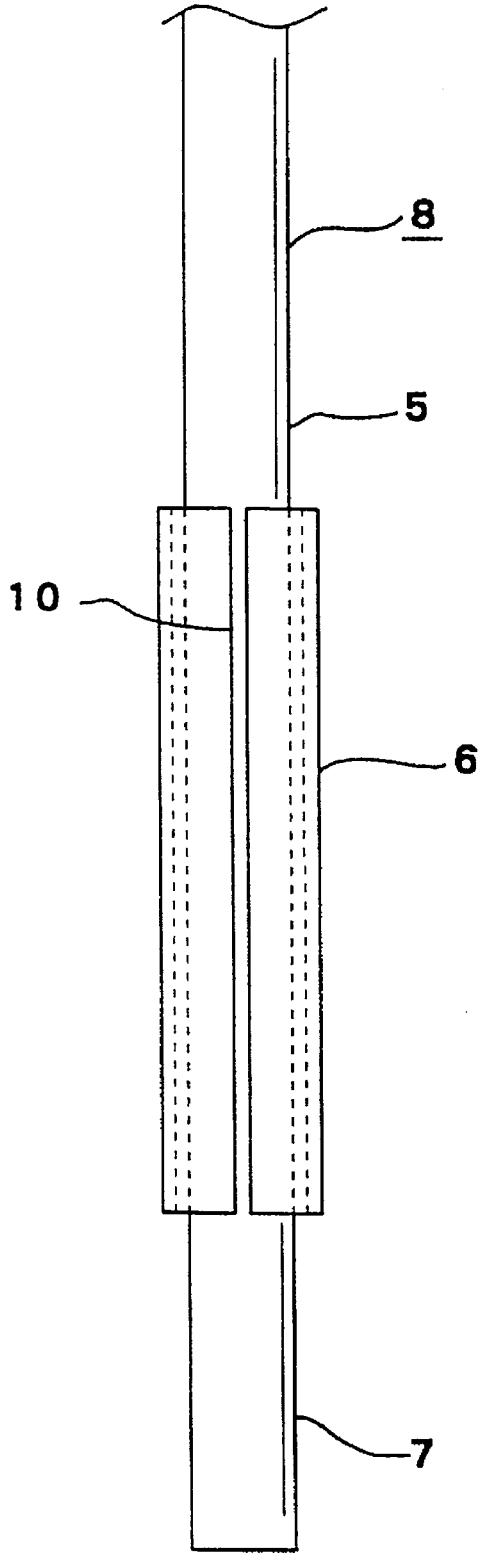
FIG. 2 shows in enlarged side view a tubular weight according to the present invention fixed on the tube main body.

The tubular weight 6 can be fixed onto the tube main body 5 by caulking the tubular weight 6. Caulking is performed by squeezing the tubular weight 6 by 1/100 mm to 1/10 mm so as to grip the tube main body 5. In doing so, passage of an aerosol content 9 (see FIG. 3) through the tube main body 5 is not hindered, and the tubular weight 6 does not slip off the outer peripheral surface of the tube main body The tubular weight 6 may be caulked partly, or evenly over the entire length thereof. If the tubular weight 6, having a slit 10 along the longitudinal direction thereof, as shown in FIG. 2, is caulked, the tubular weight 6 can evenly be caulked over the entire length with minimal cross-sectional deformation. If the slit 10 is not provided, as shown in FIG. 4, the tubular weight 6 can be formed using a ready-made stainless steel tube or the like. In this case, the tubular weight 6 is partly caulked onto the tube main body 5.

The thus obtained dip tube 8 is used after being assembled with and hung from the valve mechanism in the housing 3. When the aerosol content 9 is to be sprayed, the stem 4 is depressed via a push button (not shown) to open the valve mechanism. The opening of the valve mechanism allows the aerosol content 9 to be introduced into the free end of the tube main body 5 and sprayed through a nozzle provided in the push button etc. to the outside.

Figure 3:
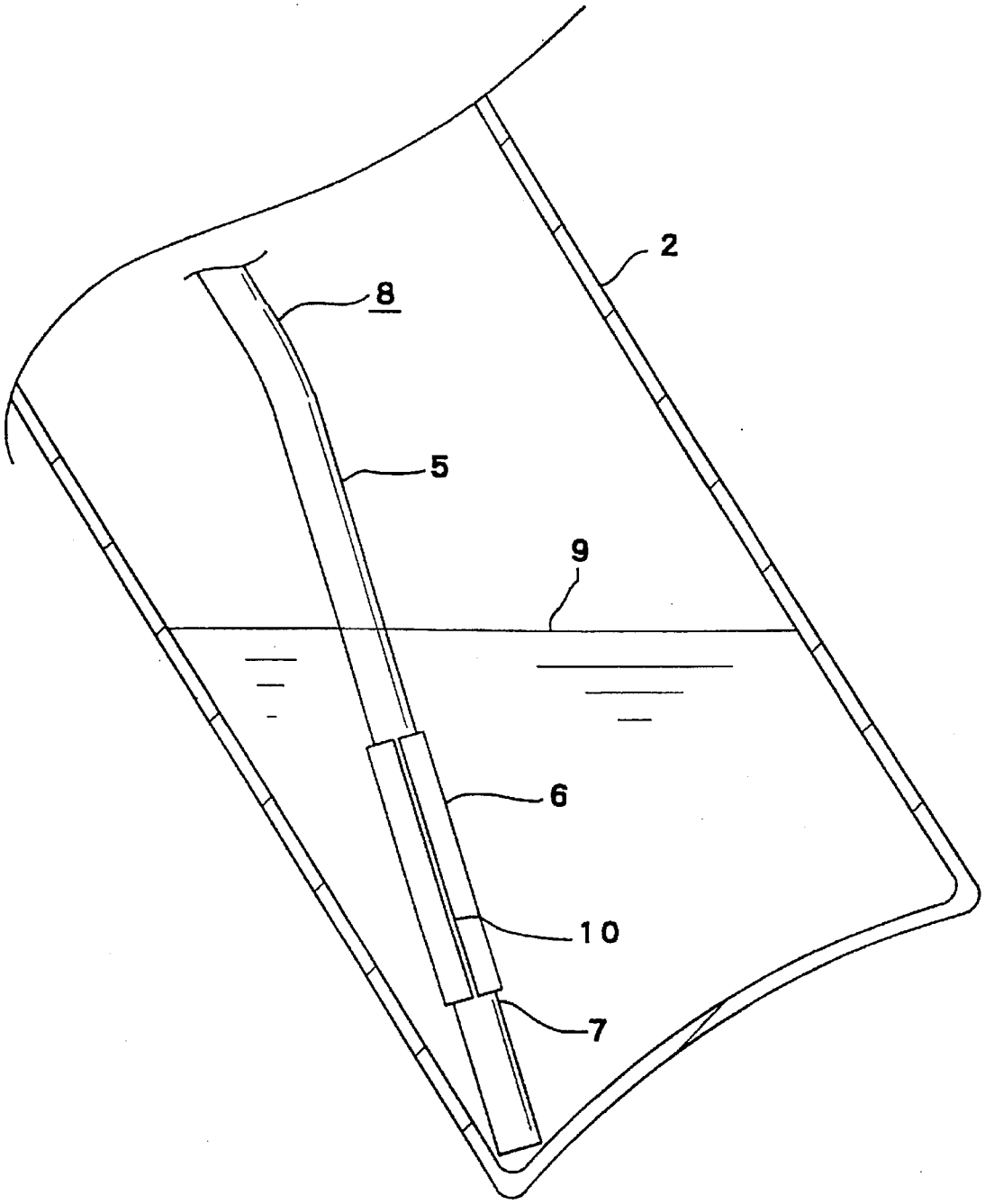
FIG. 3 shows in partial cross-sectional view the protrusion of the free end portion of the tube main body from the tubular weight and how the free end portion can reach a nook at the bottom of an aerosol container.
Figure 4:
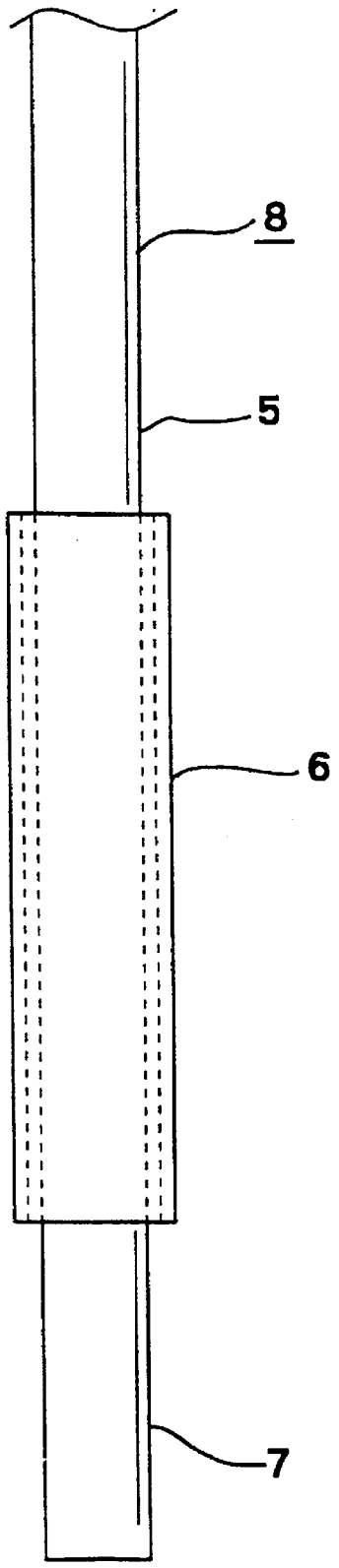
FIG. 4 is an enlarged side view of the present invention, similar to FIG. 2, of a tubular weight according to another embodiment.

When the aerosol container 2 is slanted, the pliable tube main body 5 is bent by the weight of the tubular weight 6 in the same direction as the container 2 is slanted (see FIG. 3). Therefore, no matter how the aerosol container 2 is slanted or inverted, the tip protrusion 7 of the tube main body 5 follows the aerosol content 9 to keep contact therewith, thus enabling one to spray all of the aerosol content 9.

Even if the tube main body 5 moves because the aerosol container 2 is jostled, only the tip protrusion 7 contacts the inner surface of the aerosol container 2. The thin tubular weight 6 fixed to the tube main body 5 above the tip protrusion 7 is substantially prevented from contacting the inner surface of the aerosol container 2.

The constitution of the present invention is as described above. Accordingly, the tubular weight does not hit the inner wall surface of the aerosol container. Therefore, the tip protrusion of the tube main body, having a small diameter, can reach the nooks of the aerosol container, so that the aerosol product can be economically used with virtually no aerosol content remaining unused therein.

Since the aerosol content is constantly kept in contact with the tip protrusion, exhausting only the propellant gas contained in the aerosol container to the outside can be avoided.

Besides, since the tubular weight is designed not to hit the inner surface of the aerosol container even when the aerosol container is slanted, the inner peripheral surface of the aerosol container is protected from damage.

Further, the tubular weight is not coated on its outer periphery but can be directly fixed onto the tube main body. Therefore, attaching the tubular weight is greatly facilitated, improving workability and reducing production costs.

In addition, since the position of the tubular weight relative to the tube main body can be freely chosen, the length of the tip protrusion can be freely adjusted depending on the size of the aerosol container, shape of nooks, etc. Thus, it is possible to realize an arrangement where the amount of the aerosol content remaining unsprayed is minimal and where the inner surface of the container is protected from damage.

What is claimed is:

1. A dip tube adapted to be hung within a container having an interior surface, comprising:

a pliable tube main body; and a tubular weight including a slit along a longitudinal direction thereof whereby said tubular weight is caulked onto an exterior periphery of said tube main body, adjacent an end of said tube main body, wherein an end portion of said tube main body protrudes from said tubular weight, a length of said end portion being sufficient to substantially prevent said tubular weight from contacting the interior surface of the container.

2. A dip tube according to claim 1, wherein said tubular weight has an outer diameter of 4 to 6 mm.

3. A dip tube according to claim 1, wherein said tubular weight has a length of 20 to 40 mm.

4. A dip tube according to claim 1, wherein said tubular weight is made from a stainless steel material.

5. A dip tube according to claim 1, wherein said tubular weight has a length of 20 to 40 mm.

6. A dip tube according to claim 1, where said tubular weight is made from a stainless steel material.

7. A dip tube according to claim 1, wherein said end portion is between about 5 mm and about 15 mm long.

8. An aerosol can comprising:

an aerosol container having an open end and an interior surface;

a cover including a valve mechanism mounted thereon, said cover being arranged so as to close off said open end of said aerosol container;

a pliable dip tube connected at a first end to said valve mechanism and arranged within said aerosol container so as to leave a second end free therein; and a tubular weight including a slit provided along a longitudinal direction thereof, whereby said tubular weight is caulked onto said dip tube adjacent to said second end, thereby leaving an end portion of said dip tube exposed, said end portion of said dip tube have a length sufficient to be interposed between said tubular weight and said interior surface of said aerosol container.

9. An aerosol container according to claim 8, wherein said end portion is between about 5 mm and about 15 mm long.

10. An aerosol container according to claim 8, wherein said tubular weight has an outer diameter between about 4 mm and about 6 mm.

11. An aerosol container according to claim 8, wherein said tubular weight is about 20 mm to about 40 mm long.

12. An aerosol container according to claim 8, wherein said tubular weight is made from a stainless steel material.

13. An aerosol container according to claim 8, wherein said tubular weight has a length of about 20 mm to about 40 mm.

14. An aerosol container according to claim 8, wherein said tubular weight is made from a stainless steel material.

* * * * *